US005219369A

United States Patent [19]

Gastle et al.

[11] Patent Number: 5,219,369

[45] Date of Patent: Jun. 15, 1993

[54] VETERINARY SUPPORT DEVICE

[76] Inventors: Thomas H. Gastle; James E. Gastle, both of P.O. Box 430, Lakefield, Ontario, Canada, K0L-2H0

[21] Appl. No.: 731,661

[22] Filed: Jul. 17, 1991

[30] Foreign Application Priority Data

Apr. 12, 1991 [CA] Canada ..... 2020401

[51] Int. Cl.[5] ..... A61G 1/02

[52] U.S. Cl. ..... 5/600; 5/625; 119/102

[58] Field of Search ..... 119/102, 103; 296/20; 5/620, 625, 626, 627, 600

[56] References Cited

U.S. PATENT DOCUMENTS

| | | | |
|---|---|---|---|
| 1,344,088 | 6/1920 | Lundbom | 5/626 |
| 1,487,941 | 3/1924 | Hammett | 119/103 |
| 2,349,023 | 5/1944 | Van Der Hyde | 5/626 |
| 4,428,326 | 1/1984 | Dubovick et al. | 119/102 |
| 4,567,853 | 2/1986 | Hayden | 119/103 X |

FOREIGN PATENT DOCUMENTS 3515808 11/1986 Fed. Rep. of Germany .

*Primary Examiner*—Robert P. Swiatek

[57] ABSTRACT

A veterinary support device has a support element, a wheeled undercarriage including a pair of castered leg arrangements, couplers to removably couple the leg arrangements to the support element, wherein the device has a first operable position with the leg arrangements removed to function as a stretcher and a second operable position with the leg arrangements coupled to the support element to function as a gurney, the support element including a pair of beams, a carrying portion positioned on the beams to carry an animal; each of the beams having a pair of ends, each of the leg arrangements being further arranged to be releasably connected to a corresponding pair of ends by the couplers.

7 Claims, 7 Drawing Sheets

VETERINARY SUPPORT DEVICE

BACKGROUND OF THE INVENTION

Reference to Copending Application

The subject matter of copending patent application Ser. No. 521,996 filed in United States Patent Office on May 11, 1990 is incorporated herein by reference.

1. Field of the Invention

The present invention relates to gurneys and more particularly to those for use in veterinary clinics.

2. Description of the Related Art

Gurneys are used extensively in the human medical environment to transport patients from one location to another. The human gurney is typically about six feet long and two feet wide and has a castered wheel undercarriage.

It is also common to find these human gurneys in a veterinary clinic. The difficulty, however, appears when a veterinarian attempts to use the common human gurney to transport a large animal, such as a dog, from one location to another. The human gurney is simply too large and bulky to fit through the small doorways and hall ways of a veterinary clinic. For this reason, dogs are being carried from one location to another.

It is therefore an object of the present invention to provide a novel gurney more suited to the veterinary environment than the conventional human gurney.

SUMMARY OF THE INVENTION

Briefly stated, the invention involves a veterinary support device comprising a support means, a number of downwardly oriented connector portions, a wheeled undercarriage including a number of castered legs, each of the legs being removably connected to the support means by way of a connector means, wherein, the device has a first operable position with the legs removed to function as a stretcher and a second operable position with the legs connected to the support means to function as a gurney.

BRIEF DESCRIPTION OF THE DRAWINGS

Preferred embodiments of the present invention will now be described, by way of example only, with reference to the appended drawings in which.

DESCRIPTION OF THE PREFERRED EMBODIMENTS

Figure 1:
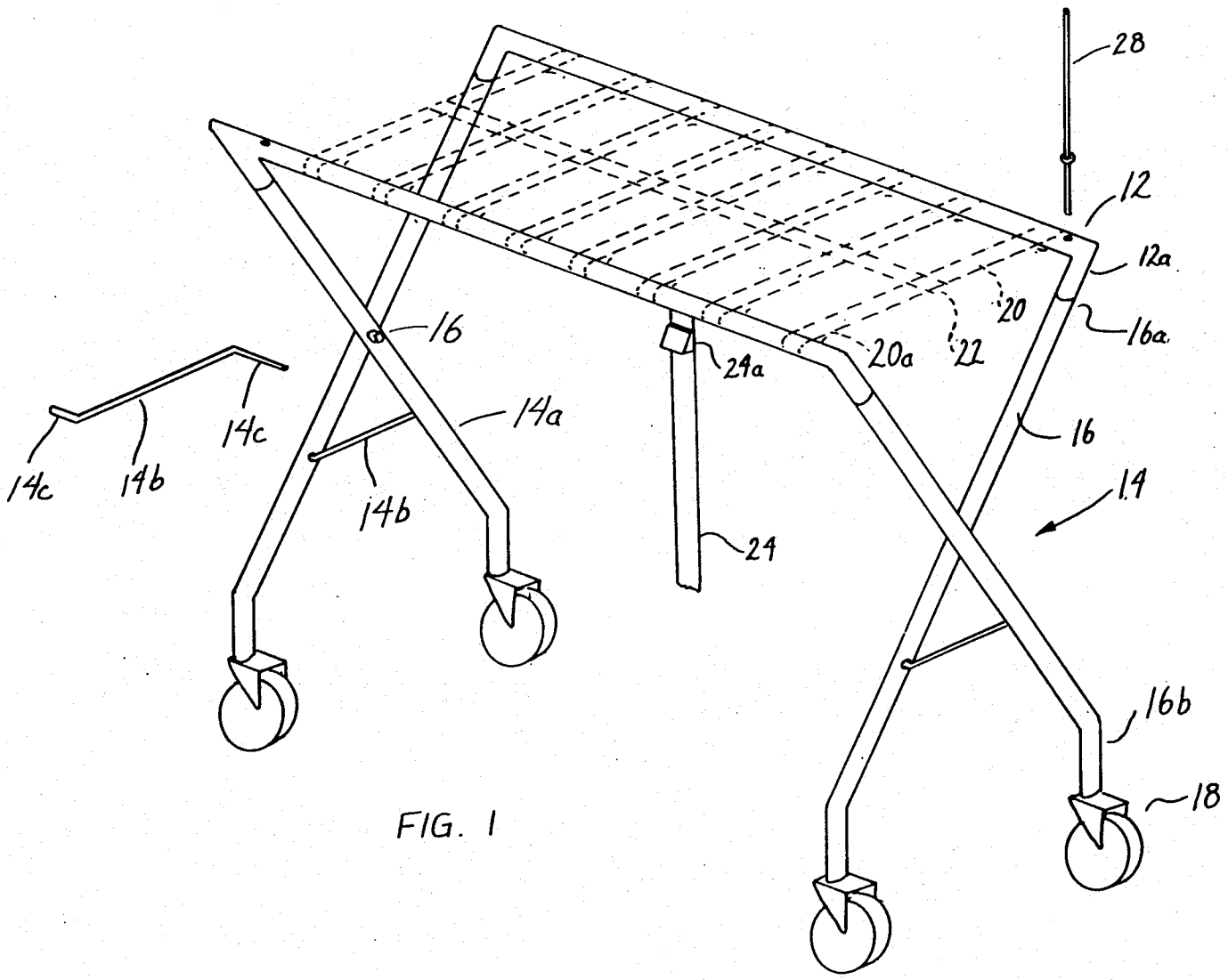
FIG. 1 is a perspective view of a gurney.

Referring to the figures, there is provided a gurney 10 having a support means in the form of a pair of beams 12, each with a pair of connector portions in the form of a pair of ends 12*a* and a wheeled undercarriage including a pair of scissored leg arrangements 14 attached to the respective ends 12*a*. Each of the scissored leg arrangements 14 has a pair of legs 16 pivoted together at a pivot bolt 14*a*.

Provided on each of the leg arrangements 14 below the pivot bolt 14*a* is a brace 14*b* having a pair of oppositely directed arms 14*c*, each of which passes through a corresponding hole in the respective leg 16. One of the arms is shorter than the other to permit the shorter arm to be withdrawn from its corresponding hole to collapse the scissored leg arrangements 14.

Each leg 16 has an upper end 16*a* which telescopingly engages with a corresponding beam end 12*a* and a lower end 16*b* which is bent relative to the leg 16 so that, in an operative position, the lower end 16*b* is in a generally vertical position to support a wheel 18. If desired, each wheel 18 may be castered and provided with brakes.

Forming a support surface on the gurney 10 is a number of belts 20, each with a pair of looped ends 20*a* that are entrained on the respective beams 12. A central longitudinal belt 22 extends down the middle of the bed and maintains the position of the belts 20.

Figure 4:
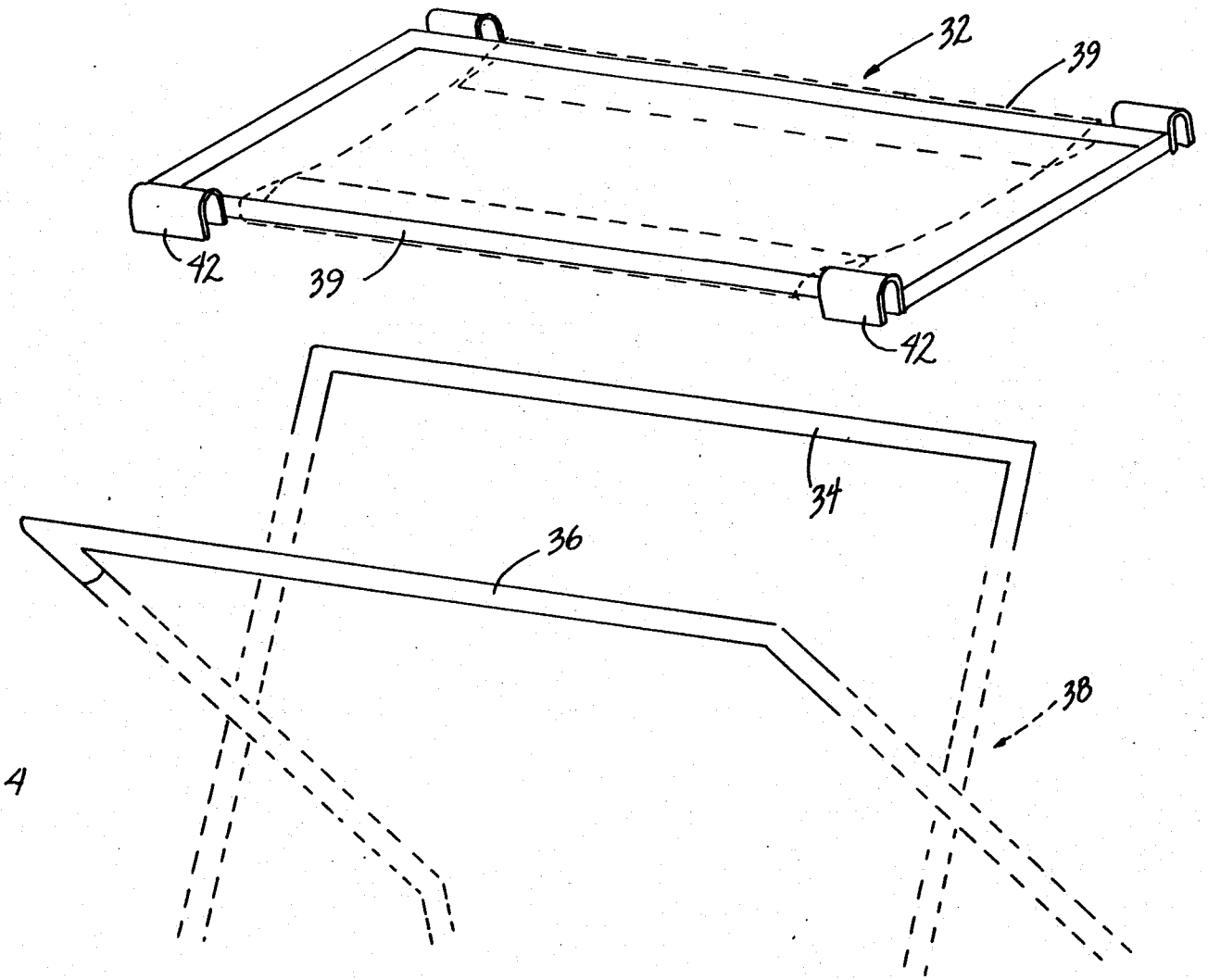
FIG. 4 is a fragmentary perspective view of another gurney.
Figure 6:
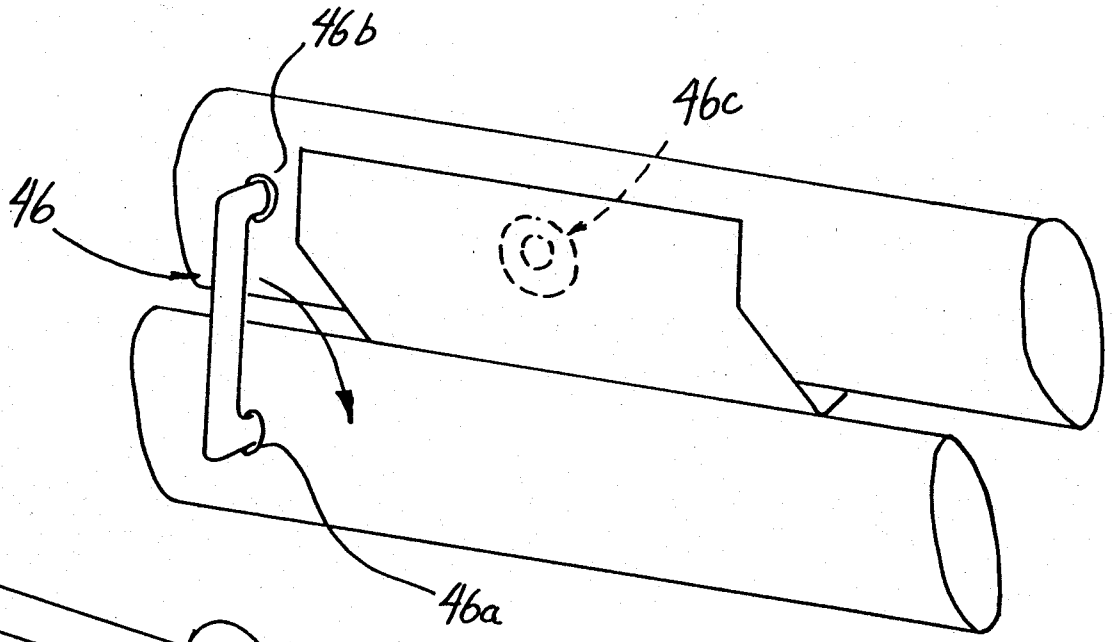
FIG. 6 is a magnified perspective view of a portion of the gurney illustrated in FIG. 5.

If desired, the support surface may be formed in another way, for example by the use of netting or some other sheet material supported on either side by the beams 12 as illustrated in FIG. 4.

If desired, the belts 20 may be length adjustable so that the depth of the bed can be adjusted.

As will be described in more detail, the gurney has two operative positions, a first wherein it functions as a stretcher and another wherein it functions as a gurney.

The gurney 10 has several particular features. It is dimensioned so that it can be moved through a small clinic to reach areas previously unaccessible with a conventional gurney. Specifically, the gurney 10 has length of about four feet, a width of about eighteen inches and a height of about three feet. Of course, the gurney 10 can be made with different dimensions and not affect its performance.

Figure 3:
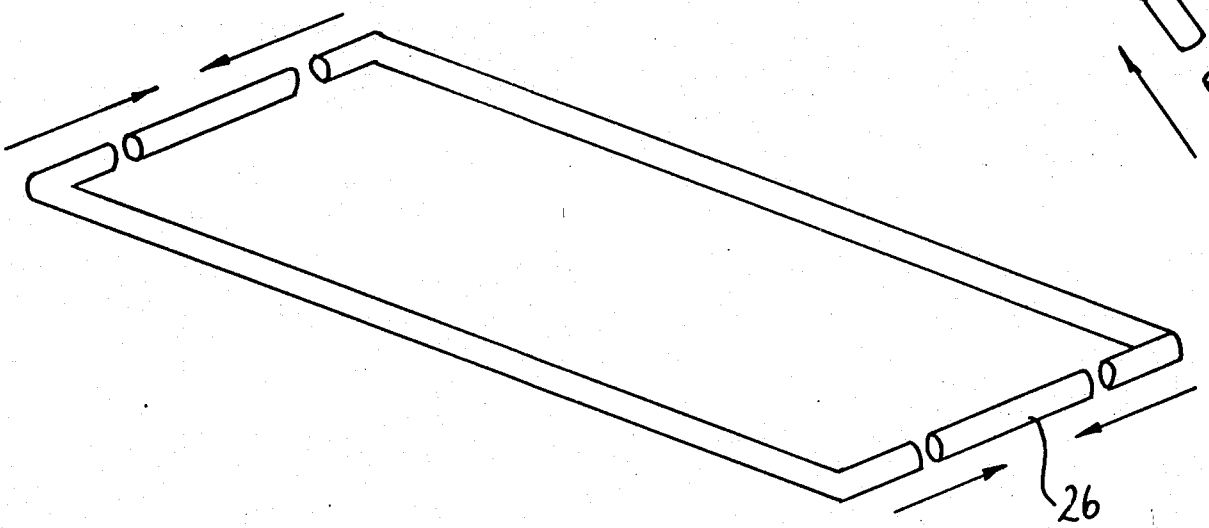
FIG. 3 is an assembly view of a stretcher using a portion of the gurney illustrated in FIG. 1.

The beams 12 are retractable from the leg arrangements 14 and with the use of a pair of adaptors 26 illustrated in FIG. 3, the beams 12 can be easily converted into a stretcher as shown in FIG. 3.

Figure 2:
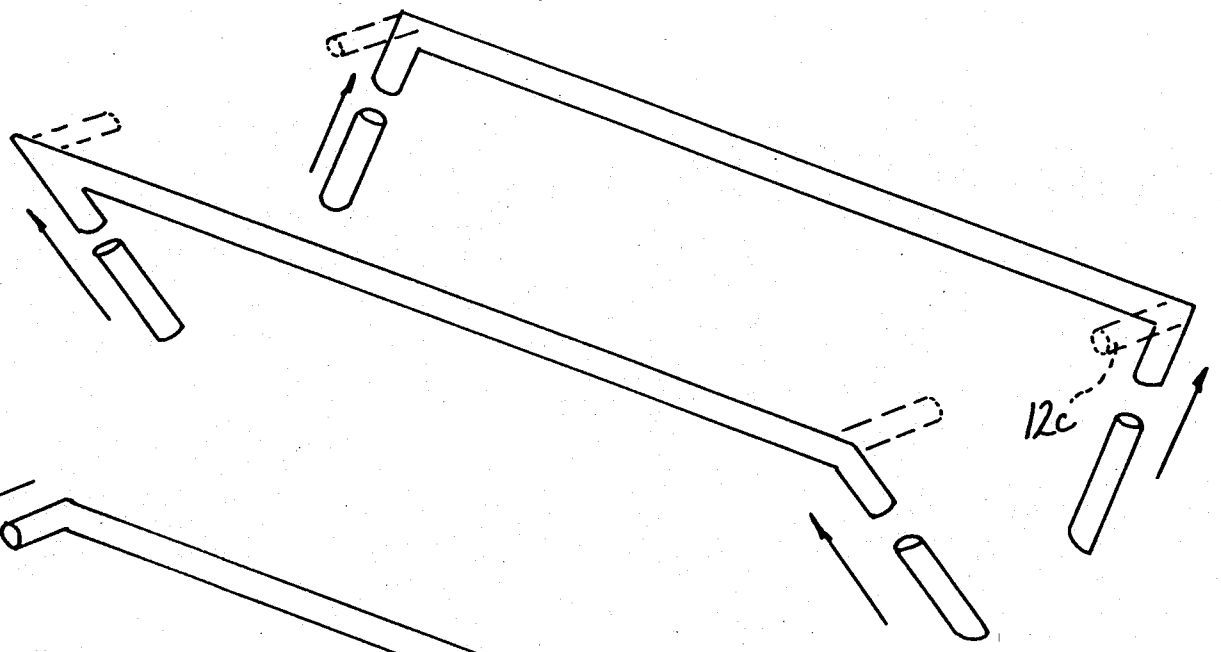
FIG. 2 is a fragmentary perspective view of one portion of the gurney illustrated in FIG. 1.

Alternatively, the beams 12 may be provided with a transverse support member between each of the beams 12 as shown in dashed lines at 12*c* in FIG. 2. In this case, when the scissored leg arrangement 14 is removed from the beam ends 12*a*, the stretcher is already in n assembled condition, thereby eliminating the need for the adaptor.

Each of the beams 12 has a hole at one end that is formed to be generally vertical when the table is in an operative position. These holes can be used as receptacles for an intravenous stand 28, an instrument tray or the like.

Also provided on the beams 12 are a number of cross belts 24 with releasable fasteners in the form of buckles 24*a* at one end to permit an animal to be secured to the bed.

In use, the veterinarian can support a dog or any other suitably sized animal on the gurney 10, secure the animal with the cross belts 24 and transport the animal from one location to another in the clinic.

If the veterinary has the need for a stretcher, he may release the brace 14*b* on either end of the table by withdrawing the shorter arm from its corresponding hole, the leg arrangements 14 may be scissored together to slacken the belts 20. The beams 12 may then be removed from the leg arrangements 14. The veterinarian then grasps the adaptor and inserts one end of each adaptor into a corresponding opened end of the beam and the other end of each adaptor into the open ends 12*a* of the other beam.

Another gurney 30 is illustrated in FIG. 4. In this case, a separable stretcher frame 32 is releasably connected to an undercarriage 34. The undercarriage has a pair of frame members 36 removably connected to a pair of leg arrangements 38. The stretcher frame 32 includes a pair of beams 39 and a pair of saddle members 42 are located between each beam 39 and its corresponding frame member 36, thereby enabling the stretcher to be aligned with the undercarriage. Each saddle member is located on a corner of a beam 39 and has an inner surface arranged to slide on the outer surface of the corresponding frame member 36. If desired, a spring loaded button or the like (not shown) may be used to secure the saddle member 42 in position on the frame member 36.

Figure 5:
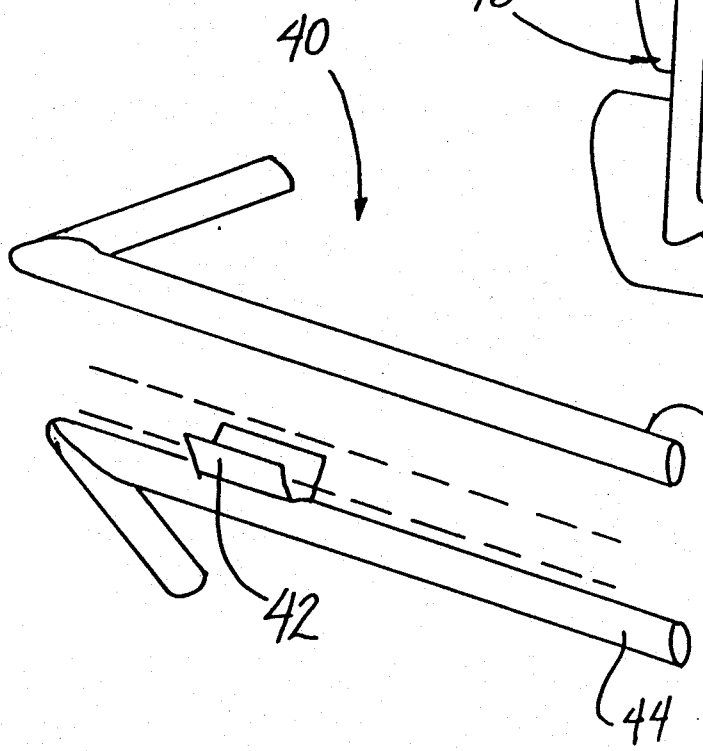
FIG. 5 is a fragmentary perspective view of yet another gurney.

Referring to FIG. 5, another gurney 40 is illustrated with the saddle member 42 mounted on the beam 44 rather than on the stretcher beam 45 as in the earlier embodiment. A spring loaded locking pin 46 is also provided to secure the stretcher beam in the saddle members 42. The locking pin is a double right angled member with one end spring loaded in a hole 46*a* in the beam 44 and the other end aligned with a hole 46*b* in the stretcher beam 45. If desired, the hole 46*b* may be aligned with a corresponding hole in the saddle member (as shown by the dashed lines at 46*c*) and the locking pin 46 and hole 46*a* accordingly.

Figure 7:
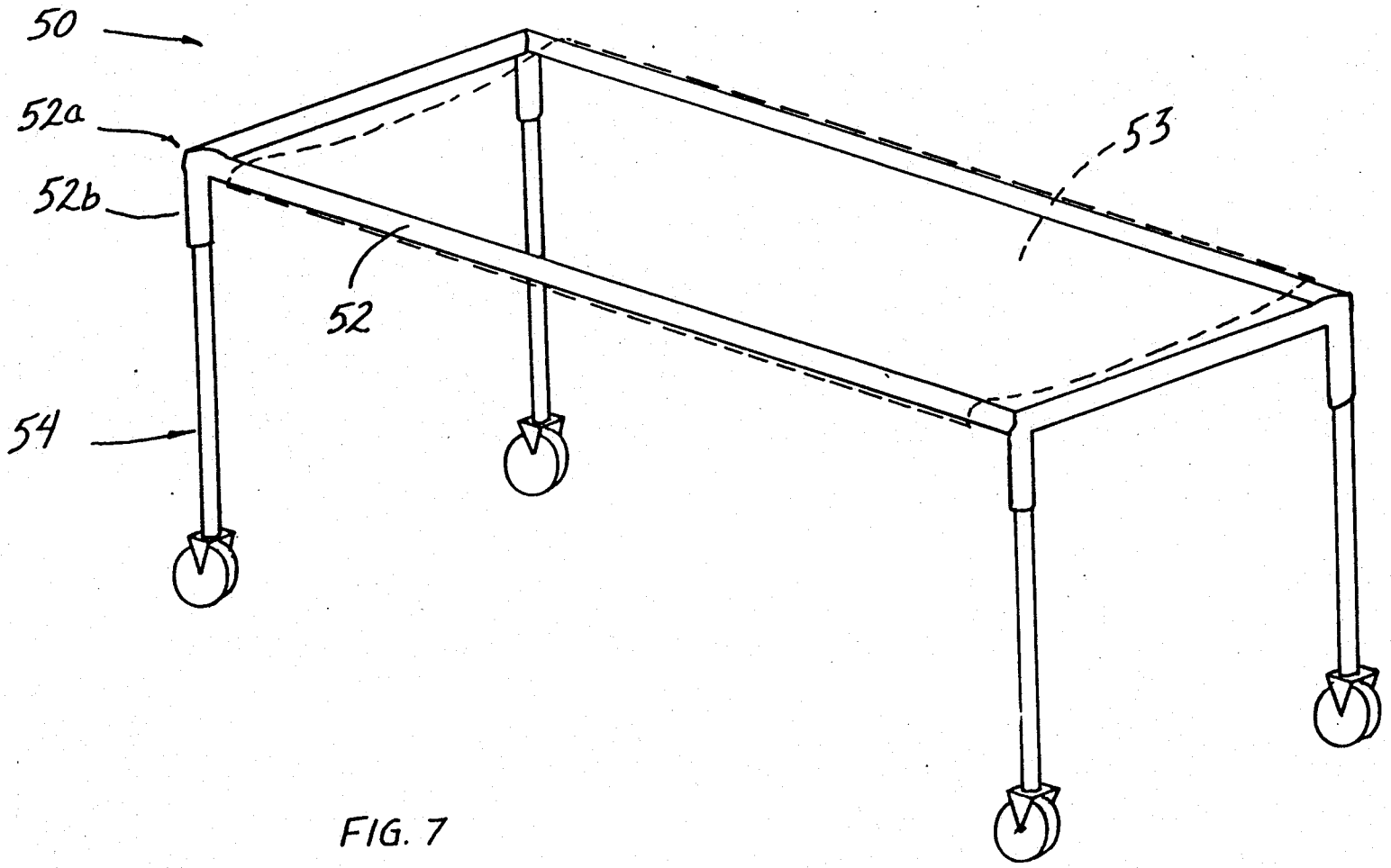
FIG. 7 is a perspective view of still another gurney.

Yet another gurney is illustrated at 50 in FIG. 7. In this case, the gurney is a rigid stretcher portion 52 with a sleeve 53 to support an animal. The stretcher portion 52 has four corners 52*a*. A downwardly oriented connector portion 52*b* is fixed at each corner 52*a* and is removably connected to a corresponding castered leg 54.

Figure 8:
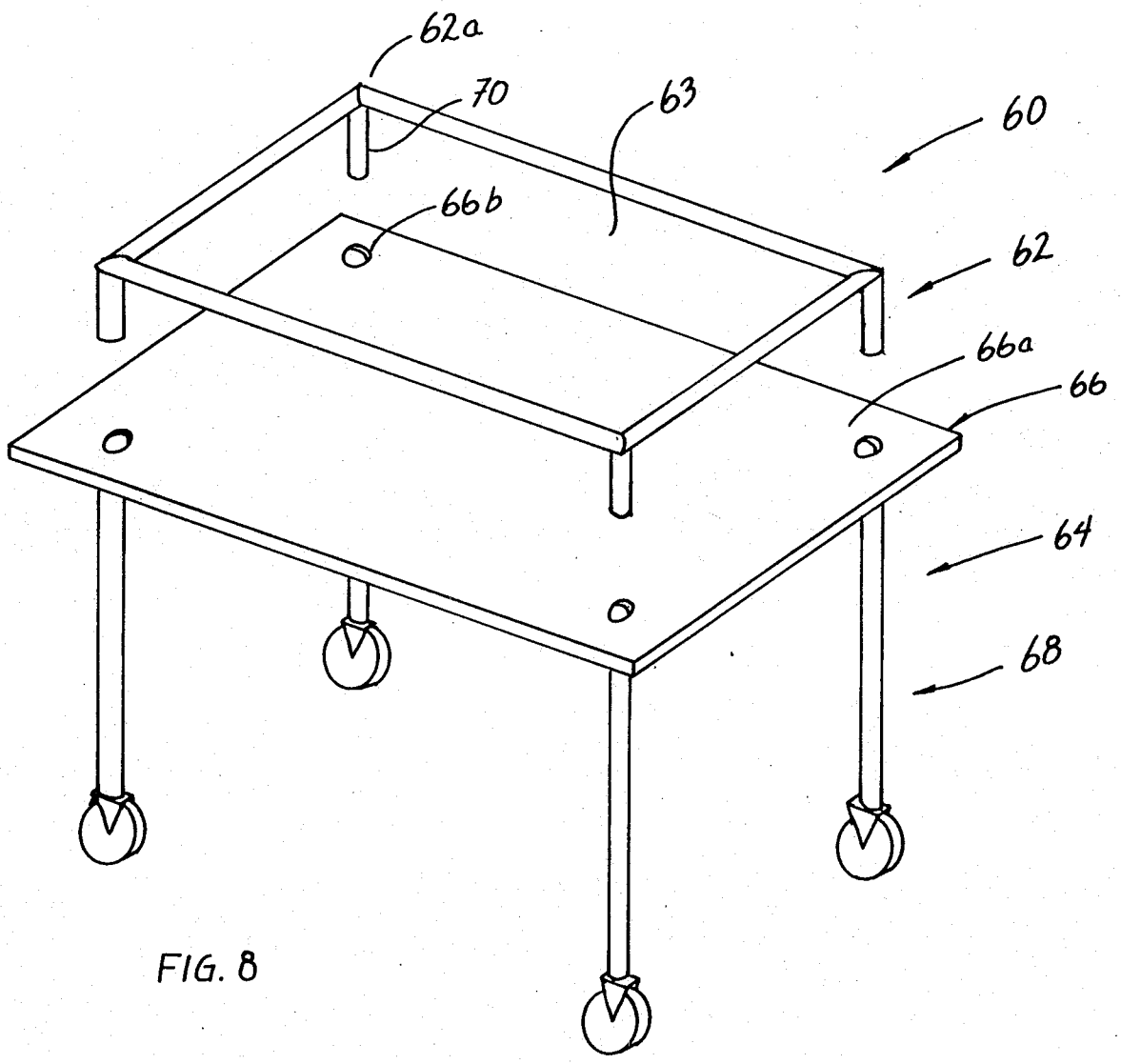
FIG. 8 is a perspective view of still another gurney.

Yet another gurney is illustrated at 60 in FIG. 8. The gurney 60 has a stretcher portion 62 which is removably attached to a base frame 64 having a panel 66 forming a table surface 66*a* and four castered legs 68. The stretcher portion 62 has four corners 62*a* each of which has a connector portion 70 extending from the lower face thereof. The connector portion 70 fits into a corresponding aperture 66*b* in the table surface 66*a*. The gurney 60 is advantageous in that the base 64 may be used as a preparation table when the stretcher is disconnected while the table surface 66*a* functions as a utility shelf when the stretcher is connected.

If desired, the legs 68 may be removable from the panel 66 and additional support members may be provided between the legs and panel as required, of course depending on the weight to be placed on the gurney.

Figures 9, 10:
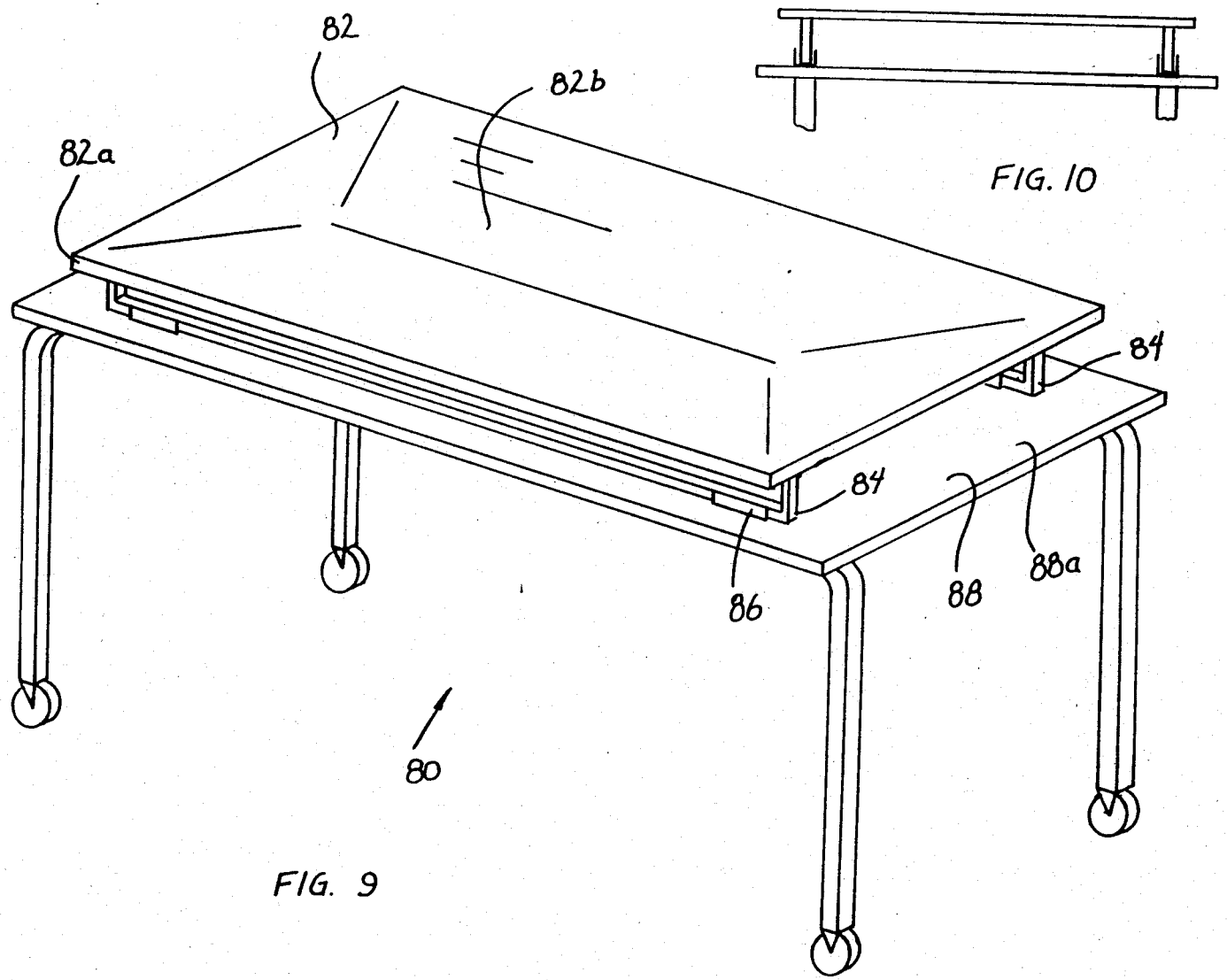
FIG. 9 is a perspective view of still another gurney.
FIG. 10 is an end view of the gurney illustrated in FIG. 9.

Yet another gurney is illustrated at 60 in FIGS. 9 and 10. Gurney 80 has a stretcher portion 82 with edges 82*a*, an inwardly tapered top surface 82*b* and a pair of support rails 84 extending the length of the edges 82*a*. The support rails are rectangular in cross section and are removably located in four saddle members 86 fixed to a base panel 88. The base panel has a top surface 88*a* and a lower surface 88*b* to which four castered legs are attached. Like earlier embodiments, the gurney has a removable animal support portion to transport an animal and a wheeled base on which to transport the animal support portion.

We claim:

1. A veterinary support device comprising a support means, a wheeled undercarriage including a pair of castered leg arrangements, coupling means to removably couple said leg arrangements to said support means, wherein said device has a first operable position with said leg arrangements removed to function as a stretcher and a second operable position with said leg arrangements coupled to said support means to function as a gurney, said support means including a pair of beams, carrying means positioned on said beams to carry an animal; each of said beams having a pair of ends, each of said leg arrangements being further arranged to be releasably connected to a corresponding pair of ends by said coupling means, said device further including a pair of adaptor means, each of which is arranged to be releasably attachable to a corresponding pair of ends, wherein in said first operable position, said adaptor means are joined to said beams to form said stretcher.

2. A veterinary support device comprising a support means, a wheeled undercarriage including a pair of castered leg arrangements, coupling means to removably couple said leg arrangements to said support means, wherein said device has a first operable position with said leg arrangements removed to function as a stretcher and a second operable position with said leg arrangements coupled to said support means to function as a gurney, said support means including a pair of beams, carrying means positioned on said beams to carry an animal; each of said beams having a pair of ends, said wheeled undercarriage being further arranged to be releasably connected to said beams near said ends, each of said leg arrangements including a pair of legs and pivot means to pivot said legs together, said legs having lower ends which are bent so as to be in a generally vertical position when said leg arrangements are in an operative position.

3. A veterinary support device as defined in claim 2 wherein said wheeled undercarriage further comprises a pair of frame members joining said leg arrangements together, said coupling means further including releasable connection means to removably connect said support means with said frame members.

4. A veterinary support device as defined in claim 3 wherein said carrying means includes a sheet material providing a support surface and supported by said beams, said beams being alignable with said frame members for releasable connection therewith.

5. A veterinary support device as defined in claim 4 wherein said releasable connection means further includes several saddle members located between a respective beam and its corresponding frame member for aligning said stretcher with said undercarriage.

6. A veterinary support device as defined in claim 5 wherein said saddle members are attached to said frame members.

7. A veterinary support device as defined in claim 6 further comprising a plurality of spring loaded members to removably secure said beams in said saddle members.

* * * * *